United States Patent [19]

Lovett et al.

[11] Patent Number: 4,927,995

[45] Date of Patent: May 22, 1990

[54] ENCLOSED TOWEL WARMER

[76] Inventors: Robert R. Lovett; Donna M. Lovett, both of 8407 Lindley #3, Northridge, Calif. 91325

[21] Appl. No.: 314,936

[22] Filed: Feb. 24, 1989

[51] Int. Cl.[5] ..... H05B 3/20

[52] U.S. Cl. ..... 219/385; 219/521

[58] Field of Search ..... 219/385, 386, 521, 218; 34/151, 239, 243 R, 201, 202, 240, 148

[56] References Cited

U.S. PATENT DOCUMENTS

| | | | |
|---|---|---|---|
| 2,571,918 | 10/1951 | Meningen | 34/151 |
| 2,852,861 | 9/1958 | Jarrell | 34/151 |
| 2,971,266 | 2/1961 | Silva | 219/521 |
| 3,138,699 | 6/1964 | Taylor | 219/521 |
| 3,849,629 | 11/1974 | Graham | 219/521 |
| 4,117,309 | 9/1978 | Cayley | 219/521 |
| 4,694,146 | 9/1987 | DeMars | 219/521 |

*Primary Examiner*—Teresa J. Walberg
*Attorney, Agent, or Firm*—J. E. McTaggart

[57] ABSTRACT

For commercial and residential use, a wall-mounted enclosed towel warmer has a bottom-hinged tilt-out front cover which includes an integral top panel. In the tilted-out cover position an internal towel holder also tilts outward to provide convenient top access for loading or removal of a towel. When the cover is pushed closed, a latch retains it in the closed position where the exterior presents a smooth flat profile having only a shallow protrusion of a few inches from an unaltered wall surface, providing a high degree of user safety, especially regarding children. In this closed position, the towel becomes intimately sandwiched between several thin profile electric heating elements located on both sides of the towel holder and on inner surfaces of the enclosure, arranged to warm the towel uniformly to avoid hot and cold regions which tend to occur with conventional open type towel-warming devices. A front control panel provides touch pads and illuminated message displays. Automatic shutoff is provided in the event the warmed towel is not removed within a preset time, approximately 15 minutes, after which a new warming cycle could be initiated.

13 Claims, 3 Drawing Sheets

ENCLOSED TOWEL WARMER

FIELD OF THE INVENTION

This invention relates to towel-warming devices for use in homes, hotels, hospitals, health clubs, passenger ships, and the like. More particularly it relates to towel-warming devices of the wall-mounted enclosed type.

BACKGROUND OF THE INVENTION

The desirability of having a warmed towel available after bathing or showering has been well known over a long period of time. A warmed towel serves to offset the well known chilling effect due to evaporation of water from the body after showering, even at normal room temperatures. Numerous circumstances arise, especially in chilly environments, where the convenient availability of a warmed towel whenever needed could becomes an important factor in the well-being, health or survival of individuals who may be frail or under medical treatment and thus vulnerable to thermal shock between showering (or bathing) and drying.

In recognition of this need, public care institutions such as hospitals are usually equipped with industrial type warming oven for warming quantities of towels; however, there exists a widespread need elsewhere for warmed towels which is not adequately served at present.

DISCUSSION OF THE PRIOR ART

A heating appliance, disclosed in U.S. Pat. No. 3,138,699 to Taylor, typifies a rudimentary approach in which a towel or other fabric article could be draped over an inverted U shaped heated form extending from a wall mount. This configuration, which utilizes a central electric light bulb as the heating element, suffers from a number of basic disadvantages; in particular, the inefficient heat transfer from the element to the form due to the large air space involved would make the warm-up time excessively long, away beyond the length of time one normally spends showering. The cantilevered disposition, extending away from the wall, and the detachable wall-mount suggest a tentative, potentially unstable expedient rather than a sound and aesthetically attractive installation.

U.S. Pat. No. 3,217,137 to Weitzner for a HEATED TOWEL RACK AND HANGER discloses a heated roller apparatus upon which a towel could be spirally rolled, heated in the rolled position and then drawn off for use when heated. U.S. Pat. No. 3,160,734 to Rylander for an ELECTRICALLY HEATED TOWEL DRIER also discloses a roller type heater, however the Rylander device is directed to drying towels after use rather then pre-heating towels for use.

Graham, in U.S. Pat. No. 4,559,442 discloses a wall-mounted tubular vertical heating element having various shaped horizontal plates or wire forms as towel hangers, attached to the element and extending outward from the wall.

A type of towel warmer having warmed oil circulating in a plurality of horizontal tubular towel supports in a generally ladder-shaped flat vertical roll-about configuration is known in the prior art, particularly in Europe.

All of the above-described prior art towel warming device suffer the disadvantage that, being of the open type without any outer enclosure, they expose the towel to the room atmosphere during heating, causing a heat loss which reduces heating efficiency and thus increases warming time and energy cost. Furthermore this uncontrolled heat loss introduces large variations in towel temperature depending on the time duration, room temperature, air drafts and various other factors. Also, open type towel warmers tend to warm the towel unevenly, leaving portions of it cold while other portions may become too hot. This uneven heating can force a compromise in seeking a satisfactory tradeoff between effectivity and safety hazard tradeoff: if sufficient heating energy is applied to achieve a desired short warmup time, some point on the exposed heated holder way reach an excessive temperature that could burn the skin or scorch the towel.

All utility devices of this type offered to the public are strictly regulated with regard to safety including skin burn, shock and fire hazard. Generally, it is extremely difficult to design an open type device, satisfying all public safety regulations, which will heat a towel up uniformly to a good usable temperature in the short time one spends in a shower, say two minutes, and which will thereafter reliably keep the towel at a constant proper and safe temperature in the event the towel does not get used immediately.

Among further disadvantages of open towel warmers of the abovedescribed types, beyond their intrusion into the space of a room, is the tendency to invite children to climb or pull themselves up on exposed tubular members, creating a hazard to themselves, the device and/or the building, or at least considerable annoyance.

An unfulfilled need exists for an enclosed type personal towel warmer, as opposed to known institutional multiple-towel enclosed types and known open personal types, which overcomes the aforementioned disadvantages and problems and which can promptly and safely warm up a towel and hold it ready for use at constant optimal temperature.

SUMMARY OF THE INVENTION

It is a primary object of the present invention to provide an enclosed type towel warmer for personal use.

It is a further object to an enclosed type towel warmer having a relatively flat generally rectangular profile, adapted to mount onto a flat existing wall with minimal structural modification, and having an overall configuration which is non-hazardous, particularly with regard to children.

It is a further object to provide a towel warmer in a wall-mounted tilt-out configuration having a touch-pad control panel.

These and other features and advantages have been provided in the towel warmer of this invention, which will be best understood through study of the following description and the drawings.

DETAILED DESCRIPTION

Figure 1:
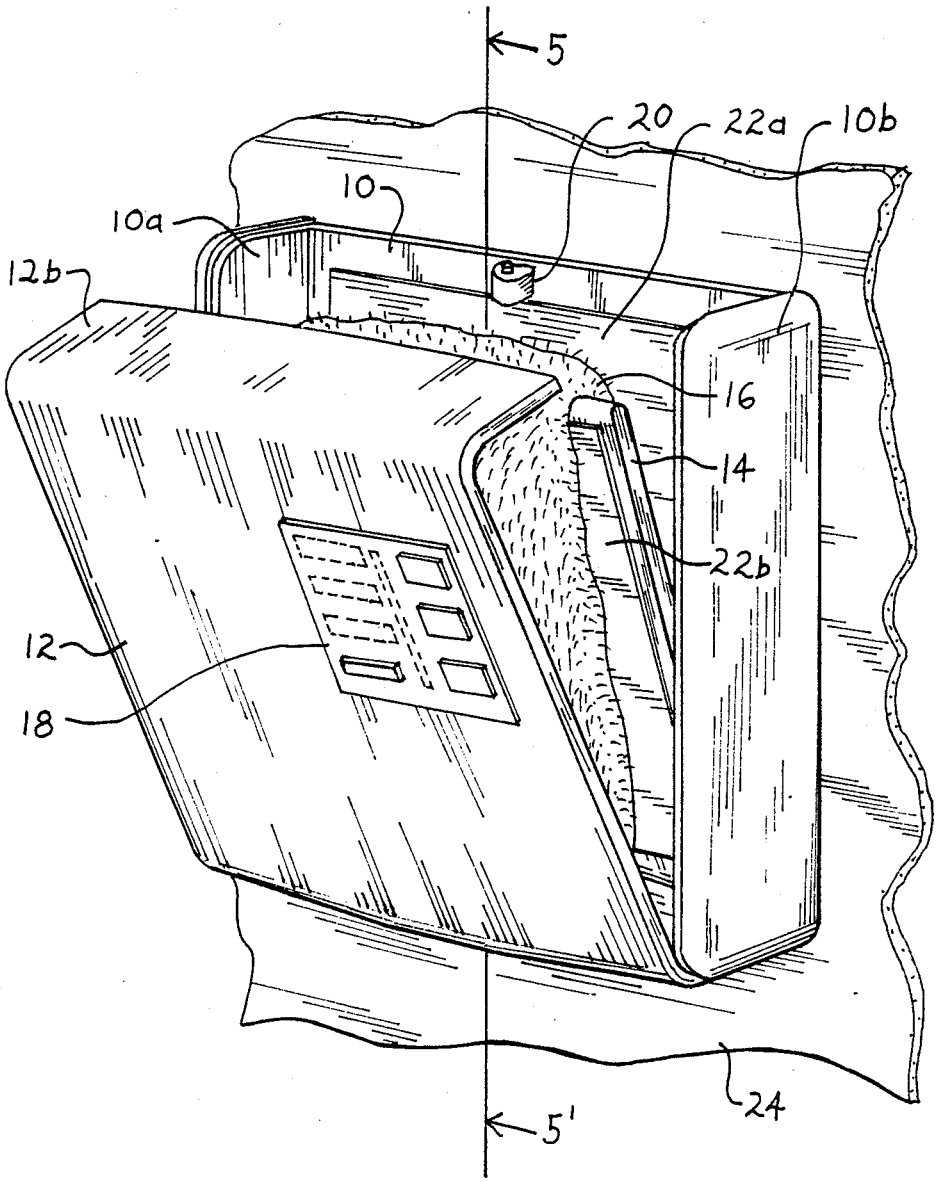
FIG. 1 is a perspective view of the towel warmer of this invention showing the cover in its open position.

The perspective view of FIG. 1 shows a towel warmer illustrative of this invention in a preferred embodiment. The towel warmer comprises three major elements: a main body 10 including side panels 10*a* and 10*b*, a cover 12, hinged to main body 10 along the bottom, and a towel holder 14 pivotally attached to side panels 10*a* and 10*b*, near the bottom. A towel 16 is shown placed in position over towel holder 14 which is made to have a rounded upper edge as shown. The cover 12 is fitted with a touch-pad control panel 18, and the main body 10 is fitted with a solenoid latch 20, centrally located near its top edge. Thin wall electrical warming elements 22*a* and 22*b* may be seen, located on the inside of the rear panel of main body 10, and on the towel holder, respectively. The towel warmer assembly is fastened by conventional means to an interior wall 24 at a convenient height.

Figure 2:
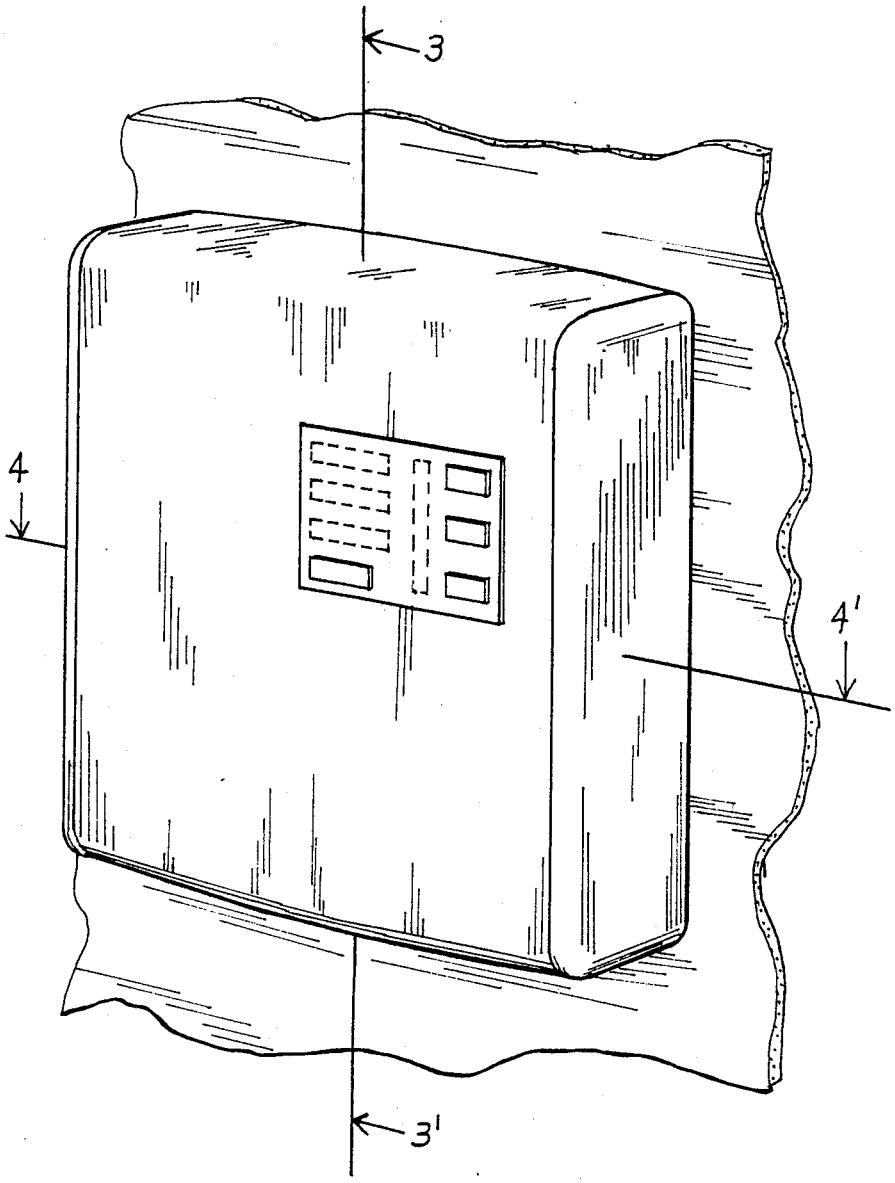
FIG. 2 is a perspective view of the towel warmer of this invention showing the cover in its closed position.

The perspective view of FIG. 2 shows the same subject towel warmer with cover 12 in its closed position, where the rear edge of top panel 12*b* is now positioned close to wall, and the side edges of cover 12 fit flush with main body end panels 10*a* and 10*b* to provide smoothly contoured exterior surfaces.

Figure 3:
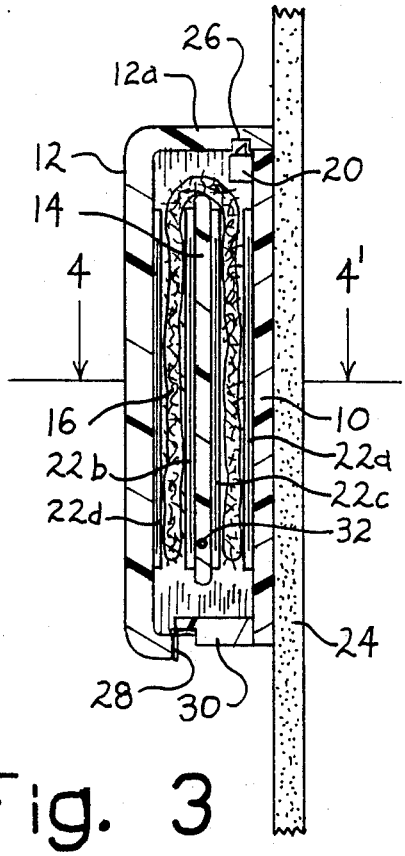
FIG. 3 is a sectional side elevation of the closed towel warmer taken through line 3–3' in FIG. 2.

FIG. 3, a sectional elevation taken through line 3–3' of FIG. 2, shows the interior of subject towel warmer with cover 12 in its closed position, where it is held in place by solenoid latch 20 engaging an opening 26 on the bottom side of cover top panel 12*a*. The plunger of latch 20 is spring loaded so as to automatically latch mechanically when cover 12 is pushed to the closed position shown. In this position, towel 16 is warmed by four thin wall electric elements: 22*a* and 22*b* (as seen in FIG. 1), 22*c* on the rear side of towel holder 14, and 22*d* on the rear side of cover 12. Along the bottom, piano type hinge 28 secures the cover 12 to a bottom plate 30 of main body 10. Towel holder 14 is pivoted on each side to the main body end panels by captivated pins at location 32.

Figure 4:
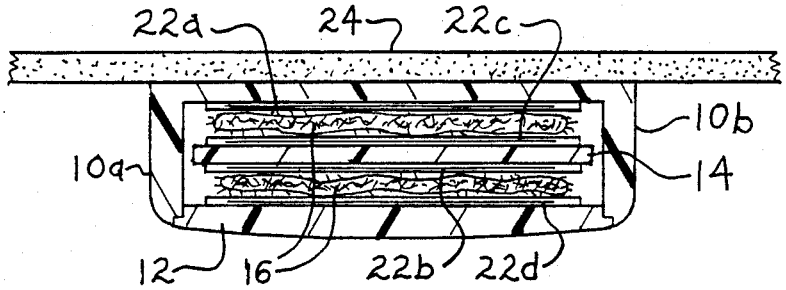
FIG. 4 is a sectional plan view of the closed towel warmer taken through line 4–4' of FIG. 2.

FIG. 4 shows a sectional plan view of subject warmer in its closed condition, as viewed at line 4–4' of FIG. 2. Again towel 16 is seen sandwiched between the warming elements 22*a*, 22*b*, 22*c*, and 22*d*. The main body side panels 10*a* and 10*b* are seen providing a jamb configuration to form a flush fit with the side edges of cover 12 to achieve a smooth exterior contour.

Figure 5:
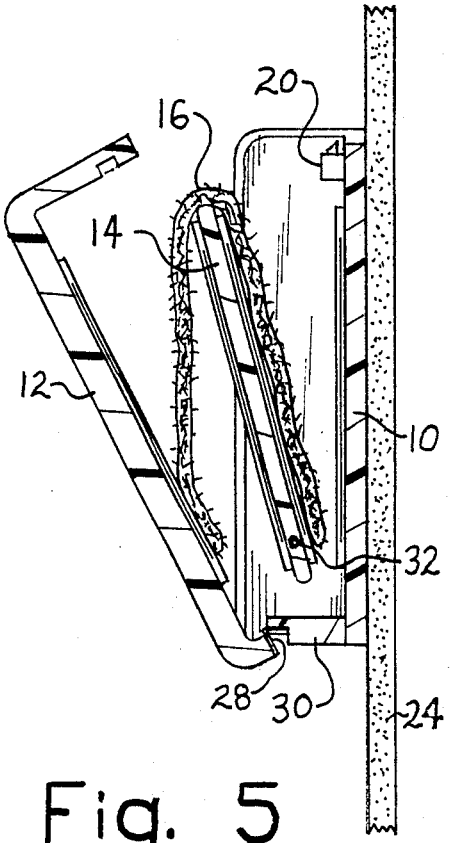
FIG. 5 is a sectional side elevation of the open towel warmer taken through line 5–5' of FIG. 1.

FIG. 5 shows a sectional side view of subject towel warmer in its open condition as seen at line 5–5' of FIG. 1. The cover 12, fastened by hinge 28 to bottom plate 30 of main body 10, is shown tilted away from wall 24 so as to allow insertion or removal of towel 16, shown supported on towel holder 14, pivoted at location 32. Cover 12 and towel holder 14 are constrained against tilting further than the approximate positions shown by stopping means well known in the art of cabinetry.

Referring once again to FIG. 2, control panel 18, in a preferred embodiment, provides a touch pad designated OPEN, located in the lower left region of the panel, a vertical row of three touch pads designated HOT, MEDIUM and WARM in the right hand region of the panel, and four flashing message displays, indicated in the drawing by dashed lines: READY, WARMING and LOAD TOWEL above the OPEN touch pad, and SELECT TEMP located to the left of the HOT, MEDIUM and WARM touch pads.

The OPEN touch pad is adapted to energize the solenoid of latch 20 and thus retract its plunger to release the cover 12 from its closed position (FIGS. 2, 3 and 4) and allow it to tilt outward to the open position (FIGS. 1 and 5). As an optional refinement, there may be provided a hydraulic or pneumatic device to avoid abrupt opening of cover 12 when released by latch 20. Not shown in the drawings, such devices are well known in the cabinetry art as door closers.

The HOT, MEDIUM and WARM touch pads are adapted to cooperate with a three-level thermostatic control device to energize the heating elements 22*a* through 22*d* and to limit the temperature of the towel to designated values; typically 160, 130 and 110 degrees Fahrenheit respectively.

Typically subject towel warmer will be operated in the following manner in order to warm a towel:

The towel warmer remains in the closed position of FIG. 2 in a standby state when not in use, and normally a towel is not left stored inside. Immediately before showering or bathing, the user presses the OPEN touch pad, releasing cover 12 to its open position of FIG. 1, tilted outward from wall 24, with towel holder 14 tilted out part way ready to receive a towel. The control panel 18 flashes the LOAD TOWEL message. A dry towel 16, typically folded once longitudinally, is placed over towel holder 14 as shown in FIGS. 1 and 5, and the cover 12 is pushed to its closed position where it latches in place as shown in FIG. 3. Control panel 18 then flashes the SELECT TEMP message to prompt the user to make a selection by pressing one of the HOT. MEDIUM and WARM touch pads, whereupon the WARMING message is flashed while the towel is being warmed by heated elements 22*a* through 22*d*. In approximately two minutes, when the correct temperature has been reached, the WARMING message is replaced by the READY message, indicating that the warmed towel is being maintained at the selected temperature until needed. When ready to dry, the user presses the OPEN touch pad, and once again the cover tilts outward, now offering the warmed towel to the user, who simply lifts out the warmed towel, pushes the cover to latch it closed and proceeds to dry with the warmed towel. The towel warmer reverts to the standby state. If, for any reason, the user does not make a temperature selection when the LOAD TOWEL message is flashing or does not use the warmed towel within a predetermined time period, say 15 minutes, the towel warmer is programmed to automatically shut down and revert to the standby state.

The principal parts of the towel warmer of this invention, the main body 10, cover 12 and holder 14, are preferably molded from plastic having suitable mechanical and thermal properties, such as Corian (trademark of Du Pont de Nemours & Co.), in the Class 1 fireproof category. The dimensions chosen to accomodate a typical sized bath towel resulted in outside dimensions of approximately 17" high, 15" wide and 4" deep, the towel holder being approximately 14" high, 13" wide and ½" thick.

The electric heating elements 22*a* through 22*d* are of the etched foil type laminated within a special 0.002" thick Kapton (Dupont trademark) insulating film coated on one side with a 0.001" layer of FEP teflon, available from Watlow Electric Mfg. Co., St. Louis, Mo. The total wattage should be chosen as no more than that required to achieve the desired warmup time, typically 300 watts.

There are a number of possible refinements and variations which could be applied to the basic embodiment of this invention described above. The possible inclusion of an air circulating fan and/or vent openings is optional. Means of indicating the presence of a towel in the closed condition could be provided, for example in the form of a transparent window in cover 12.

Although the towel warmer of this invention is contemplated primarily for use with dry towels, the basic concept may be expanded to handle moist towels, either to dry them or provide them as a hot compress, subject to appropriate design considerations and modifications such as the provision of moisture-sensing means and special control and ventilation facilities.

The invention may be embodied in still other specific forms without departing form the spirit and essential characteristics thereof. The present embodiments are therefore to be considered in all respects as illustrative and not restrictive, the scope the invention being indicated by the appended claims rather than by the foregoing description; and all variations, substitutions and changes which come within the meaning and range of equivalency of the claims are therefore intended to be embraced therein.

What is claimed is:

1. A towel warming device comprising:

a main body having a substantially rectangular back panel adapted to mount vertically against a wall, a pair of vertical side panels integral with said back panel, and a horizontal bottom panel;

a cover having a substantially rectangular main portion and an integral perpendicular flange portion, said cover being adapted to cooperate with said main body to form a substantially orthogonal enclosure when said cover is disposed in a closed position relative to said main body such that said main portion of said cover is disposed vertically in engagement with said side panels so as to form a front panel of said enclosure, and said flange portion is disposed horizontally so as to form a top panel of said enclosure;

a flat rectangular towel holder member disposed between said side panels and pivotedly attached thereto in a lower region thereof, on a horizontal pivot axis, such that when said cover is disposed in said closed position, said towel holder is caused to become constrained in a substantially vertical position disposed such that a towel may be contained within said enclosure, supported upon said towel holder;

hinge means, disposed along a horizontal hinging axis, hingedly attaching said cover at a lower edge thereof to said bottom panel of said main body, whereby said cover is provided with freedom to move rotationally from said closed position outward from said wall to a tilted open position constrained by stopping means to a predetermined angle less than 45 degrees from vertical, tilting of said pivotally attached towel holder being constrained to about half said predetermined angle, thereby providing access to a towel supported upon said towel holder; and heating means adapted to warm a thusly supported towel.

2. The towel warming device as defined in claim 1 wherein said heating means comprises one or more flat substantially rectangular electrical heating elements each disposed against and affixed in one or more surfaces selected from the following surfaces of said towel warmer; an inward-facing surface of said main body back panel, a first and second side surface of said towel holder member, an inward-facing surface of said vertical main portion of said cover, and a downwardfacing surface of said flange portion of said cover.

3. The towel warming device as defined in claim 2 wherein said heating element comprises a flat etched-foil type resistive metallic heating source encapsulated centrally between a pair of thermally conductive electrically insulating sheets.

4. The towel warming device as defined in claim 3 further comprising a control panel located on an outside surface of said main portion of said cover;

a plurality of touch-sensitive keypads in a user-entry temperature-selecting group located on said control panel and adapted to enable a user to select a controlled towel temperature and to initiate energizing of said heating means upon entering such selection in said temperature-selecting user-entry sensor group;

thermostatic temperature control means, located within said enclosure, adapted to regulate average energy input applied to said heating means so as to temperature-limit said towel to a maximum temperature as selected by said temperature-selecting user-entry sensor group.

5. The towel warming device as defined in claim 4 further comprising:

a cover latch, mounted inside said enclosure in an upper region of said main body, adapted to latchedly engage said cover and to thus retain said cover in said closed position wherever said cover is manually moved into said closed position, said latch being further adapted to user-controllably disengaged said cover and allow said cover to move from said closed position to an open position such as to provide access to said towel holder for placing a towel thereupon.

a user-actuated opening sensor located on said control panel and operatively connected to said cover latch device, adapted to cause said latch device to unlatch said cover and thus allow said cover to move from said closed position to said open position in response to user actuation of said opening sensor.

6. The towel warming device as defined in claim 5 further comprising an illuminated temperature selection indicator located on said control panel and adapted to prompt a user to enter a temperature selection by way of said temperature selection sensor group whenever said cover is moved from said open position to said latched closed position in preparation for warming a towel place upon said towel holder.

7. The towel warming device as defined in claim 6 further comprising an illuminated warming indicator, located on said control panel and adapted to provide user indication of energizing of said heating means in response to entering said temperature selection by way of said temperature selecting sensor group.

8. The towel warming device as defined in claim 7 further comprising an illuminated ready indicator, located on said control panel and adapted to provide user indication of said towel being ready for use, having been warmed up to a selected temperature in accordance with said temperature selection.

9. The towel warming device as defined in claim 4 further comprising shutoff means adapted to automatically discontinue energizing of said heating means (a)

whenever said cover is unlatched and opened for warm towel removal, and (b) whenever a predetermined heating time interval has elapsed without said cover having been unlatched and opened for warm towel removal.

10. The towel warming device as defined in claim 4 wherein said temperature selecting sensor group comprises three touch pads, designated "WARM", "MEDIUM" and "HOT", and said thermostatic temperature control means is adapted to temperature-limit said towel to a first, second and third maximum temperature respectively in response to temperature selection by way of actuation of one of said touch pads, said first, second and third maximum temperatures being designated as 110, 130 and 160 degrees Fahrenheit respectively.

11. The towel warming device as defined in claim 1 further comprising a latch adapted to retain said cover in said closed position, and to commandably release said cover so as to allow said cover to tilt outward to said open position.

12. The towel warming device as defined in claim 11 wherein said latch comprises a spring-loaded plunger adapted to engage a striker opening in said cover when said cover is moved to said closed position, so as to retain said cover in said closed position, and wherein said latch further comprises an electric solenoid adapted to retract said plunger when said solenoid is energized, in a manner to unlatch said cover and thus allow said cover to tilt outward to said open position.

13. The towel warming device as defined in claim 12 further comprising a control panel located on an outside surface of said main portion of said cover, said control panel comprising a opening touch pad adapted to cause said solenoid to be energized in response to finger pressure sensed by said touch pad, thus enabling unlatching of said cover from said closed position.

* * * * *